United States Patent [19]

Ekstrom

[11] 4,026,317

[45] May 31, 1977

[54] WATERSEAL

[76] Inventor: Lars Ekstrom, 11, Stallbacken, Djursholm, Sweden

[22] Filed: Mar. 26, 1975

[21] Appl. No.: 562,367

Related U.S. Application Data

[63] Continuation of Ser. No. 390,675, Aug. 22, 1973, abandoned.

[30] Foreign Application Priority Data

Aug. 28, 1972 Sweden ..... 11088/72

[52] U.S. Cl. ..... 137/216.1; 137/247.39

[51] Int. Cl.[2] ..... F16K 9/00

[58] Field of Search ..... 137/216.1, 247.39

[56] References Cited

UNITED STATES PATENTS

| | | | |
|---|---|---|---|
| 180,859 | 8/1876 | Falk | 137/216.1 |
| 663,978 | 12/1900 | O'Brien | 137/247.35 X |
| 749,503 | 1/1904 | Tokheim | 137/216.1 X |
| 1,268,379 | 6/1918 | Murphy | 137/216.1 X |
| 1,311,287 | 7/1919 | Murphy | 137/216.1 X |
| 2,101,978 | 12/1937 | Boosey | 137/247.35 X |
| 2,564,172 | 8/1951 | Baaberg | 137/247.35 X |

FOREIGN PATENTS OR APPLICATIONS

| | | | |
|---|---|---|---|
| 931,467 | 7/1963 | United Kingdom | 137/247.49 |

*Primary Examiner*—Harold W. Weakley
*Attorney, Agent, or Firm*—Pollock, Vande Sande & Priddy

[57] ABSTRACT

A device, such as a sink trap, for the discharging of waste fluid or the like to a sewer connection. The device comprises a fluid inlet means and fluid outlet means. The fluid inlet means conveys the waste fluid to an inner one of several concentrically arranged, vertically overlapping water seals which cooperate to define a plurality of concentrically disposed chambers forming a tortuous path for waste fluid from the inlet means to the outlet means which connects to the outwardmost of the chambers.

1 Claim, 2 Drawing Figures

WATERSEAL

This is a continuation, of application Ser. No. 390,675 filed Aug. 22, 1973 now abandoned.

This invention relates generally to apparatus for a plurality of series-arranged waterseals and pertains more particularly to a sink trap or the like.

All devices which are used for blocking the passage of odours from sewers into a living space contain a waterseal which is shaped and dimensioned in accordance with the desired flow capacity, and is arranged to prevent siphoning and drying out of the seal. Other characteristics, such as resistance to leakage, mechanical strength and resistance to ageing and high temperatures are not discussed in the following.

In order to fulfill reasonable minimum-requirements in the above-mentioned respects, sink traps for instance have a certain height dimension from the lower edge of the sink trap to the finished floor. The object of the invention is to decrease this dimension especially in old construction, but also in new construction.

When applying the principle described below, it is possible to reduce the height of the device, for instance the height of the sink trap, and at the same time to prevent drying of the waterseals of the sink trap.

According to the invention a plurality of waterseals are arranged consecutively, whereby the ability of the individual waterseals to absorb fluctuation of pressure are added one to another. This effect means that the device, as compared to devices using only one waterseal either can be given lower total height or is able to provide increased ability to absorb fluctuations of pressure. Another important advantage is that drying up time is prolonged, the waterseals drying up consecutively and the diffusion ways becoming long.

In order that the waterseals shall not disturb each other but function individually when waste water is passing, the air interspaces between them should be vented so that the air pressures in these interspaces correspond approx. to the air pressure in the space before or above the device. This venting can be provided by a hole or a capillary so dimensioned that there is no time for any pressure balance to take place during the short pressure fluctuations coming from the outlet side as a consequence of flushing in the vertical main-pipe. The device can be described as containing a real, odour screening waterseal as well as one or more previous waterseals, the task of which is to support the real waterseal in response to pressure fluctuations on the outlet side and to prevent the real waterseal from drying up.

The enclosed drawing shows an example of applying the inventive idea of the invention to sink traps in bathrooms and the like.

Figure 1:
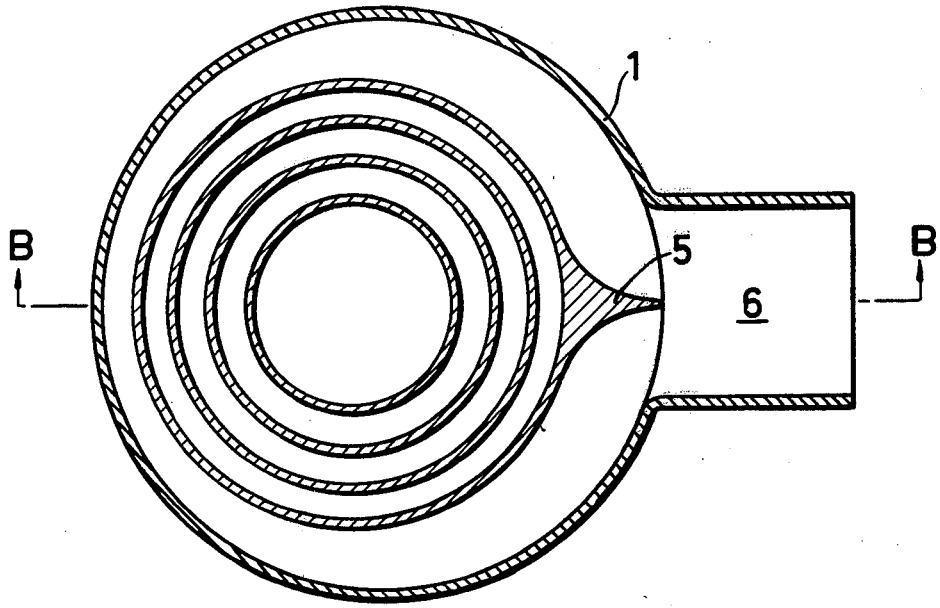
Figure 2:
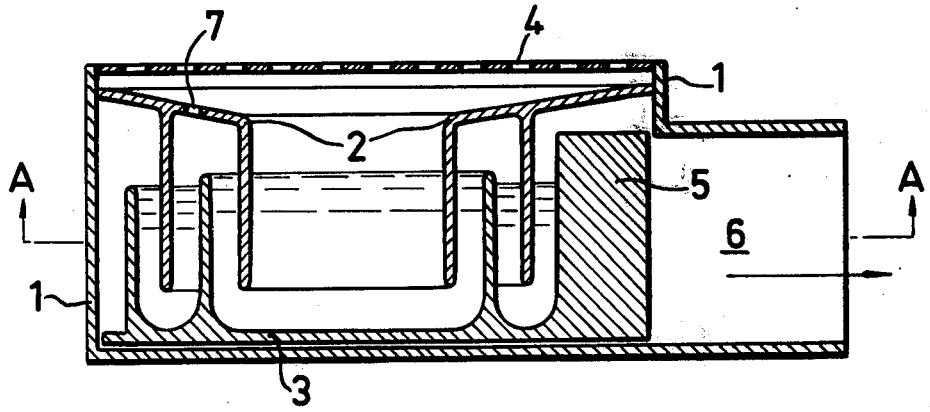

FIG. 1 is a sectional view taken along line A-A of FIG. 2, which is a vertical sectional view of a sink trap for a floor in a bathroom. Two waterseals have been concentrically arranged one after another and have also been excentrically positioned in the cover of the sink trap in order to give the outer ringduct a sectional area which increase according to the increased flow. The waterseals may be arranged in a different manner, e.g. in a straight line, but it is preferable to arrange them concentrically.

In FIGS. 1 and 2, 1 denotes the cover of the sink trap, and 2 designates a detachable top, which is sealed against the cover in a suitable way with the downwardly directed tongues of the waterseals. A detachable lower part 3 is provided with upwardly directed tongues of the waterseals. The sink trap has a grating 4 corresponding to the level of the finished floor.

The element 3 is provided with a V-shaped configuration with the apex thereof directed toward the outlet 6. An aperture 7 is provided for venting purposes.

What is claimed is:

1. A device for the discharging of liquids to a sewer connection comprising:

an upper plate defining a central aperture for receiving the liquid to be discharged, said upper plate supporting a plurality of spaced downwardly depending cylindrical ring portions, a bottom plate supporting a plurality of spaced upwardly extending cylindrical ring portions, an apertured annular wall for said device for forming with said upper plate and said bottom plate an enclosed chamber, said downwardly depending and said upwardly extending ring portions extending toward but stopping short of said bottom and upper plates respectively and being alternately interleaved in vertically overlapped relation to form thereby a plurality of waterseals joined by an air space, outlet means communicating with the aperture in said annular wall, and means in said upper plate for venting said air space.

* * * * *